US005263825A

United States Patent [19]

Doolin

[11] Patent Number: 5,263,825

[45] Date of Patent: Nov. 23, 1993

[54] LEAK CONTAINED PUMP

[75] Inventor: John H. Doolin, Gillette, N.J.

[73] Assignee: Ingersoll-Dresser Pump Company, Liberty Corner, N.J.

[21] Appl. No.: 967,256

[22] Filed: Oct. 26, 1992

[51] Int. Cl.[5] ..... F04B 19/10

[52] U.S. Cl. ..... 417/63; 417/423.1

[58] Field of Search ..... 417/9, 63, 423.1

[56] References Cited

U.S. PATENT DOCUMENTS

| | | | |
|---|---|---|---|
| 1,651,881 | 12/1925 | Fricket et al. . | |
| 2,312,525 | 9/1941 | Curtis . | |
| 3,513,942 | 11/1967 | Sato . | |
| 3,532,444 | 10/1970 | Strub . | |
| 3,746,472 | 7/1973 | Rupp | 417/9 |
| 3,967,915 | 7/1976 | Litzenberg . | |
| 4,065,231 | 12/1977 | Litzenberg . | |
| 4,115,038 | 9/1978 | Litzenberg . | |
| 4,734,018 | 3/1988 | Taniyama et al. . | |
| 5,066,200 | 11/1991 | Ooka | 417/63 |

OTHER PUBLICATIONS

Brochure of Pacific CMP Design–date unknown.

*Primary Examiner*—Richard A. Bertsch
*Assistant Examiner*—David W. Scheuermann
*Attorney, Agent, or Firm*—Jones, Day, Reavis & Pogue

[57] ABSTRACT

A configuration of pumps is presented which eliminates problems of leakage, particularly leakage from pumps handling toxic or other fluids which might pollute the atmosphere. The leak contained pumps prevent leakage to the environment and/or pump motors upon the failure of pump seals as a result of wear or other reasons by providing confinement of any potential fluid leakage between the pump and motor, said leakage being channeled to a collector sensor associated with the pump which activates introduction of additional inert gas to the motor chamber and leakage confinement zone to provide motivational pressure to the leakage fluid as needed, the leakage fluid and inert gas being transferred to a separator after passing through the sensor.

11 Claims, 2 Drawing Sheets 2
4
6
8
10
12
14
15
16
18
20
22
24
26
28
29
30
31
32
33
34
36
38
40
42
43
44
45
46
48
50
52

LEAK CONTAINED PUMP

FIELD OF THE INVENTION

The invention relates in general to a gas pressurized pump motor apparatus utilized for driving fluid pumps and in particular to pumps of the type having improved means for sealing the motor against entry of the pump fluid or liquid and maintaining any leakage fluid in the system. Thus, the invention relates to a leak contained pump that compensates for leakage as a result of seal wear wherein the pumps are provided with confinement of any potential fluid leakage between seals separating the motor and the pump with the leakage being piped through a collector device that includes a sensor to activate increased inert gas pressure in the pump motor chamber and into the leakage confinement zone providing motivation for removal of the leakage.

BACKGROUND OF THE INVENTION

An assembly of fluid pumps inclusive of driving members such as electric motors requires the provision of sealing means therebetween along, for example, the drive shaft for preventing leakage of liquids or fluids from the pump portion to the motor portion as well as a barrier for preventing provocation of flame from the motor portion to the pump portion. One class of pumps considered to be leakproof are the so-called canned motor pumps that are constructed so that the pump and motor are integrally formed. The impeller of the pump and the rotor of electric motor for operating the pump are coupled with a common shaft. The canned motor pumps utilize a seal that separates the pumped liquid from the motor solely by means of gaskets. Thus, canned motor pumps can be made leakproof by virtue of their construction and seal means. These leakproof features make pumps of the canned type more reliable than pumps of the gland packing or mechanical seal type in handling sensitive liquids, for example, environmentally harmful liquids that are not severely corrosive to iron or steel or insulated electrical wires. Such example includes most hydrocarbons. However, even these systems fail with time and use and lose their leakproof integrity.

The rotary bearing portion of these canned pumps is frequently lubricated by the pumped liquid; thus the handling of these liquids will eventually cause abnormal wear and tear of the bearing and shaft that will ultimately lead to seal failures and shutting off of the pumps or even worse leakage of harmful liquids to the environment. Proposals have been made to apply clean liquid to the bearing portion of the canned motor pump from an outside source. These proposed systems have been unable to completely prevent wear and tear of the bearing portions and seals due to the infiltration of the clean liquid by diffusion. In more recent attempts, canned motor pumps, which provide industry with, for example, centrifugal pump technology, are deemed to be able to handle fluids such as these harmful liquids without leakage. These proposed pumps utilize corrosion resistant liners or cans to isolate the motor stator windings and rotors from the pumped liquid. During operation a portion of the fluid being pumped is circulated through the motor section for cooling and lubricating and thrust control. Since some of the pumped fluid is utilized in the motor section, the need for a sealing device is proposed to be eliminated.

So-called leakproof centrifugal pumps have been proposed for environments wherein toxic and expensive fluids are transported; however, even though the pumps are deemed to eliminate sealing devices, sealing in one form or another must be present, thus the continuing need for leakage containment on the eventual failure of seal members. Thus, no satisfactory solution has been provided which answers leakage contamination of the motor and, more importantly, leakage contamination of the pump's environment, nor have these problems been resolved on how to lengthen the service life and increase efficiency of these pumps.

In accordance with the invention, a configuration of pumps is provided which eliminates problems of leakage, particularly leakage from pumps handling toxic or other fluids which might pollute the environment. Two embodiments of leak containment pumps are presented wherein both pumps are operated within a pressure controlled sealed nitrogen environment which allows for pressurized nitrogen flow from the pump motor chamber into a leakage confinement chamber between the pump housing and the motor housing. One of the containment pumps uses a more conventional motor design with an inner nitrogen purge system to keep liquid out of the motor housing while the other embodiment utilizes a cocoon pump wherein the cocoon housing is also provided with pressurized nitrogen to not only provide positive pressure in case of leakage into the cocoon chamber, but also to provide gas circulation cooling of a motor within the cocoon housing through a fan means. Both embodiments contain fluid leakage within a compartment or chamber located between the pump housing and the motor housing if and when any leakage occurs.

During normal operations, pump seals are expected to function in a normal manner, i.e., preventing leakage of the pumped fluids into the motor chamber or to the leakage confinement chamber. According to the invention, as the seals wear, leakage is confined in a chamber between the seal and the motor housing and piped to a collector-sensor approximate to the pump and then to a low pressure accumulator-separator for control and disposition. The pressurized source of inert gas or nitrogen is connected to the motor housing to keep leakage out of the motor housing and to provide motivation pressure for transporting seal leakage from the confinement chamber as required. In the event of catastrophic seal failure, liquid may enter the motor and may cause the pump to shut down. However, the sealed motor housing will prevent any leakage from contaminating the atmosphere.

A general object of this invention is to provide a sealing arrangement for electric motor driven pumps that overcomes the disadvantages noted in prior art sealing arrangements for such pumps.

A particular object is to provide such a sealing arrangement and employment of a gas under positive pressure to assist mechanical shaft sealing means in preventing the entry of pumping liquid into the motor enclosure or into the environment.

A more particular object is the provision of a seal arrangement that includes a pressurized gas within the motor enclosure coupled with a liquid confinement chamber for any leakage past the seals, the confinement chamber cooperating with liquid sensor means for increasing gas pressure in the chamber and providing motivation for leakage removal from the confinement chamber under controlled conditions.

Other objects and advantageous features of the invention will be apparent from the description of specific embodiments and the claims which define the invention.

SUMMARY OF THE INVENTION

Thus, the present invention relates to a motor driven pump comprising a motor having a sealed housing and rotating a shaft projecting therefrom, a pump housing containing a pump impeller rotated by the motor shaft, a fluid confinement chamber interposed between and sealably coupled to both the motor housing and the pump housing for receiving and draining any leakage fluid from the pump, a fluid collector coupled to the fluid confinement chamber for receiving the leakage fluid, an inert gas pressurizing the sealed motor housing to prevent leakage fluid from entering therein, and an orifice coupling the interior of the motor sealed housing to the confinement chamber for enabling gas pressure in the motor housing to force leakage fluid from the confinement chamber to the fluid collector.

BRIEF DESCRIPTION OF THE DRAWINGS

These and other objects of the present invention will be more fully understood in conjunction with the accompanying drawings in which like numerals represent like elements and in which.

DETAILED DESCRIPTION OF THE DRAWINGS

Figure 1:
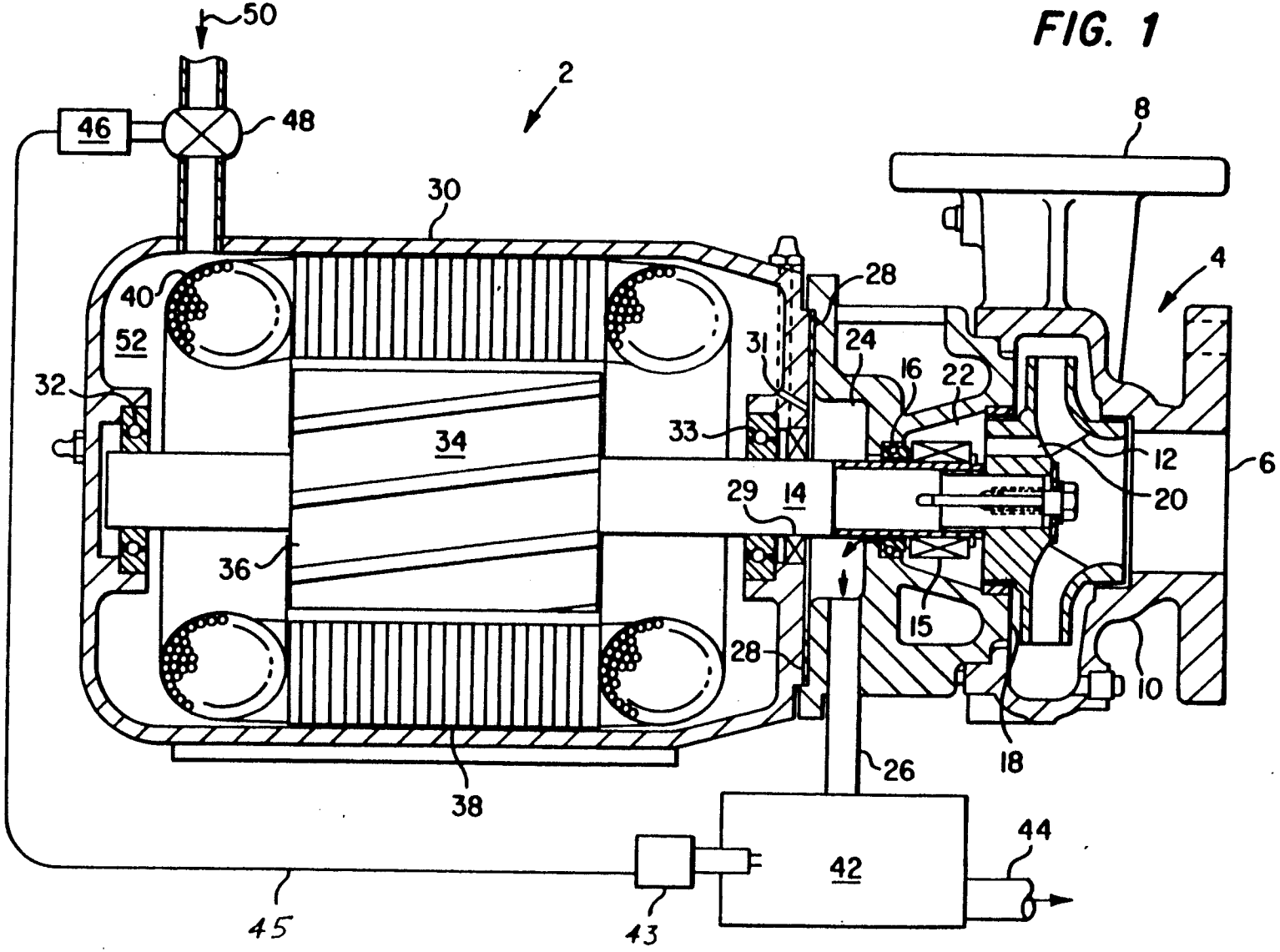
FIG. 1 is a longitudinal cross-sectional view of a leak containment pump including a diagrammatic representation of a leakage sensor, gas valve and valve activator circuit in accordance with the invention.

The preferred embodiment of the novel leak containment pump is illustrated in FIG. 1. The leak containment pump 2 comprises a centrifugal pump 4 having a fluid inlet 6 and a fluid outlet 8 forming a pump housing 10. An impeller 12 is rotatably mounted within the pump housing 10 on a pump shaft 14. Liquid seals 15 are formed between the shaft 14 and pump housing 10 to prevent any fluid being pumped from leaking towards the motor housing 30. Bearings 32 and 33 support the rotating shaft 14. A pump cover 18 is either integrally formed with or sealably attached to the pump housing 10. A pump impeller vent orifice 20 is coupled to a vent chamber 22 in which the seals 15 are located. A cavity 24 integrally formed in the pump cover 18 forms a fluid confinement chamber when the pump cover 18 is sealably attached to the sealed motor housing 30 with the use of seals 28. Conduit 26 couples the fluid confinement chamber 24 to a fluid collector 42 where any leakage fluid can be returned through line 44 to a lower pressure accumulator/ separator (not shown) for controlled disposition.

The sealed motor housing 30 includes gas seals 29 about rotatable shaft 14 projecting from the sealed housing 30 and bearings 32 and 33 support the rotatable shaft 14 at either end within the sealed housing 30. The motor 34 is preferably an electric motor and it includes a rotor 36 and a stator 38 having windings 40 thereon. A gas valve actuator 46, of any well-known type in the art, controls a valve 48 to allow pressurized inert gas 50 from a remote source, to be applied to the interior of the sealed housing 30. The inert gas may be nitrogen, for example. Thus, the interior chamber 52 of the sealed housing 30 can be pressurized with the inert gas such as nitrogen to ensure that any leakage fluid does not enter the sealed motor housing 30 through seals 29. An orifice 31 in the sealed housing 30 couples the interior 52 of the sealed motor housing 30 to the fluid confinement chamber 24 to enable gas pressure in the motor housing interior 52 to force leakage fluid from the confinement chamber 24 through conduit 26 into the fluid collector 42. It also provides a back pressure on the fluid seal 15 between the motor shaft 14 and the pump housing 10.

A liquid level sensor 43 of any well-known type is mounted in the fluid collector 42 for detecting a predetermined fluid level therein and generating an electrical signal on line 45 when the fluid reaches the predetermined level. This signal controls the gas valve actuator 46 to increase the pressure of the inert gas in the motor chamber 52, the orifice 31 and the fluid containment chamber 24 to provide a further increase in back pressure against seals 15 to prevent further leakage.

Thus, in the embodiment in FIG. 1, the motor 34 rotates shaft 14. The motor 34 includes sealed housing or cover 30. The pump housing 10 has an inlet 6 and an outlet 8 with impeller or pump 12 in the pump housing 10 being driven by the motor shaft 14 for pumping a fluid from the inlet 6 to the outlet 8. A gas seal 29 is positioned between the motor shaft 14 and the motor housing 30 and a fluid seal 15 is positioned between the motor shaft 14 and the pump housing 10. The fluid confinement chamber 24 sealably couples the motor housing 30 to the pump housing 10 such that any fluid leaking past the pump housing seal 15 is collected in the confinement chamber 24. The fluid collector 42 is coupled to the confinement chamber 24 through conduit 26 to receive any leakage fluid therein by gravity flow. The fluid level sensor means 43 in the fluid collector 42 detects a predetermined fluid level therein and generates an electrical signal on line 45 when the predetermined fluid level is reached. A source 50 of pressurized inert gas is coupled to the motor housing interior 52 through an electrically operated valve 48 that controls the flow of the inert gas to the housing interior 52. Circuit conductor 45 uses the generated signal from the fluid level sensor 43 to open the inert gas valve 48 to increase gas pressure in the motor housing 30 to seal the housing against fluid leakage.

The orifice 31 couples the interior 52 of the sealed motor housing 30 to the fluid confinement chamber 24 to enable gas pressure in the motor housing interior 52 to enter the confinement chamber and force fluid from the confinement chamber 24 through conduit 26 to fluid collector 42 and to provide a back pressure on the fluid seal 15 between the motor shaft 14 and the pump housing 10.

It will be noted that the confinement chamber 24 is actually a cavity integrally formed in the pump housing 10 that creates an enclosed chamber 24 by sealably attaching the pump housing 10 to the motor housing 30 with the use of the seals 28. It will be noted that the orifice coupling the interior 52 of the motor housing 30 to the fluid confinement chamber 24 is in the upper portion of the sealed motor housing 30 to be above any fluid collected in chamber 24.

Figure 2:
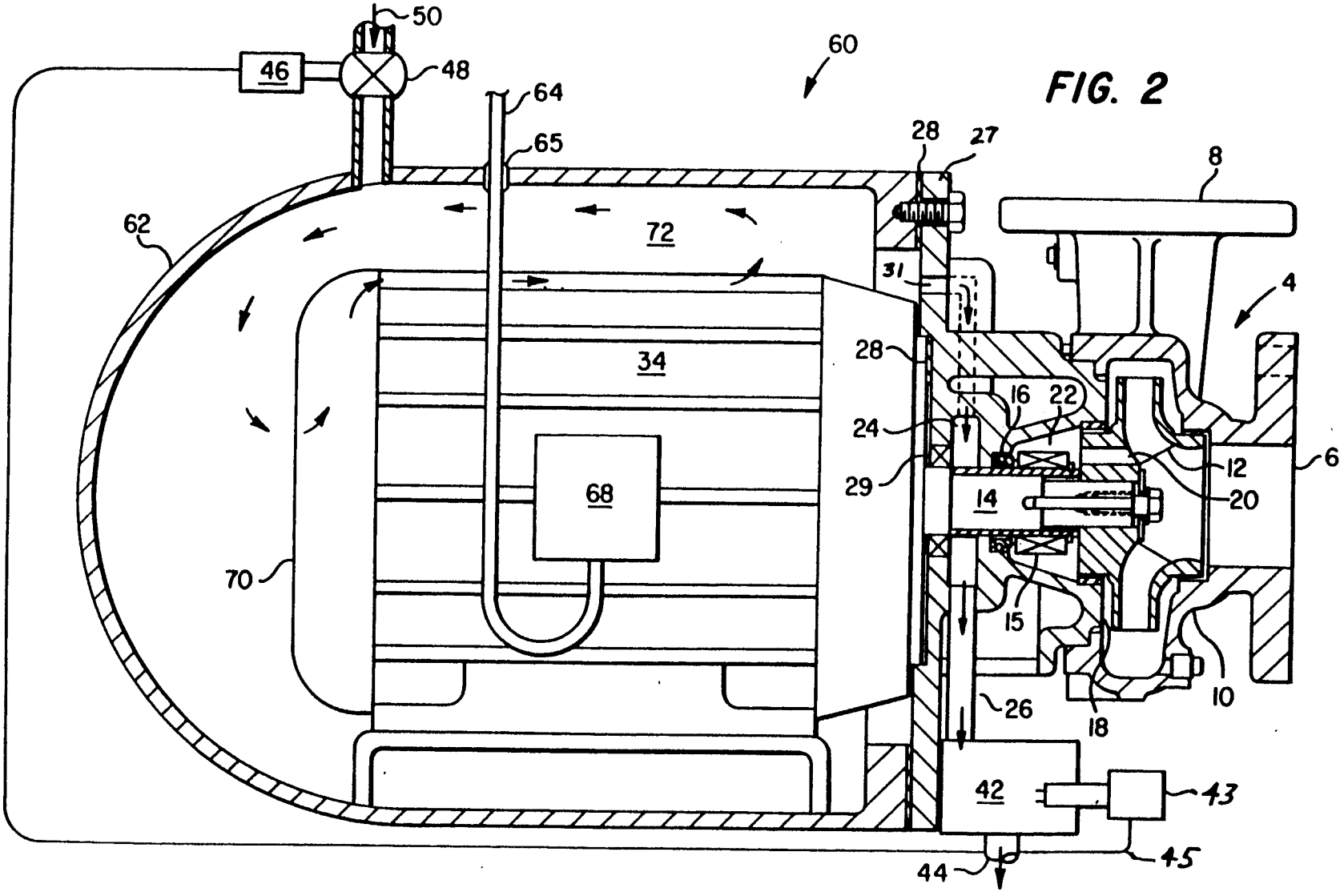
FIG. 2 is a longitudinal cross-sectional view of a cocoon pump providing leakage containment which includes a diagrammatic representation of a leakage sensor, gas valve and valve actuator circuit in accordance with the invention.

FIG. 2 is an alternate version of the leakage containment pump known generally as a cocoon pump. As can be seen in FIG. 2, the cocoon pump 60 includes a cocoon housing 62 with the power cable 64 passing through a power cable seal 65 to the junction box 68 for the motor 34. A fan carrier 70 on the back of the motor 34 moves the inert gas within the chamber housing 62 in the pattern shown by the arrows 72 for circulation and cooling of the motor 34. In the device as shown in FIG. 2, the sealable cocoon housing 62 encloses the motor 34 mounted therein for rotating shaft 14. The pump housing 10 has the inlet 6 and outlet 8. The pump impeller 12 in the pump housing 10 is driven by the motor shaft 14. Again, a fluid seal 15 is placed between the motor shaft 14 and the pump housing 10. A fluid confinement chamber 14 is interposed between the sealable chamber 62 and the pump housing 10 such that any fluid leaking past the pump housing seal 15 is collected in the confinement chamber 24. A wall 27 of the pump cover 18 serves as a common wall with and seals the sealable cocoon housing 62 using seals 28. The motor shaft 14 passes through the common wall 27 and the fluid confinement chamber 24 to the pump impeller 12. Again, a gas seal 29 is placed between the motor shaft 14 and the common wall 27. Also, there is a fluid collector 42 coupled to the confinement chamber 24 for receiving fluid therein through conduit 26 by gravity flow. Again, the fluid output from the fluid collector on line 44 is directed to a remote lower pressure accumulator/-separator for controlled disposition. The fluid level sensor 43 is mounted in the fluid collector 42 and detects the predetermined fluid level therein and generates an electrical signal at the predetermined level. This electrical signal is generated on circuit conductor 45. A source 50 of pressurized inert gas such as nitrogen is coupled to the interior of the cocoon housing 62 forming the sealed chamber. An electrically operated valve 48 is controlled by the gas valve actuator 46 to control the flow of the inert gas 50 to the interior of the sealed chamber 62. The circuit conductor 45 conducts the generated signal from the fluid level sensor 43 to the gas valve actuator 46 to open the gas valve 48 and increase gas pressure in the sealed chamber to seal the chamber 62 against fluid leakage through the gas seals 29. Again, it will be noticed that orifice 31 in the common wall 27 between the sealable chamber 62 and the fluid confinement chamber 24 enables gas pressure in the sealable chamber 62 to provide a back pressure on the fluid seal 15 between the motor shaft 14 and the pump housing 10 to prevent leakage.

It will be noted in this case that the confinement chamber 24 is a cavity integrally formed with and a part of the pump housing 10. Only the gas seals 29 separate the fluid in the fluid confinement chamber 24 from the interior of the cocoon housing 62. It will be noted also in FIG. 2 that the orifice 31 in the common wall 27 is also in the upper portion of the common wall 27.

In both the embodiments in FIG. 1 and in FIG. 2, the preferred motor is an electrical motor. Of course, other motors such as hydraulic motors could be used.

Thus, there has been disclosed two embodiments of leak containment pumps wherein both pumps are operated within a sealed pressure controlled nitrogen environment which allows for pressurized nitrogen flow from the sealed motor chamber into a leakage confinement chamber between the pump housing and the motor housing. One of the containment pumps uses a more conventional motor design with an inner nitrogen purge system to keep liquid out of the motor housing while the other embodiment utilizes a cocoon pump wherein the cocoon housing encloses the motor and is also provided with pressurized nitrogen to not only provide positive pressure in case of fluid leakage into the cocoon chamber, but also to provide the gas circulation cooling of the motor within the cocoon housing through a fan that is a part of the motor. In both embodiments, any fluid leakage from the pump is contained within a compartment or chamber located between the pump housing and the motor housing.

In each of these embodiments; in the event of a catastrophic seal failure, liquid may enter the motor or cocoon and may cause the pump to shut down. However, the cocoon or sealed housing will prevent fluid leakage from contaminating the atmosphere.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A motor driven pump comprising:

a motor for rotating a shaft, the motor sealed housing;

a pump housing having an inlet and an outlet;

a fluid impeller in the pump housing being driven by the motor shaft for pumping fluid from the inlet to the outlet;

a gas seal between the motor shaft and the motor housing and a fluid seal between the motor shaft and the pump housing;

a fluid confinement chamber sealably-coupling the motor housing to the pump housing such that any fluid leaking past the pump housing seal is collected in the confinement chamber;

a fluid collector coupled to the confinement chamber for receiving any leakage fluid therein by gravity flow;

a fluid level sensor means in the fluid collector for detecting a predetermined fluid level therein and generating an electrical signal at the predetermined level;

a source of pressurized inert gas coupled to the motor housing interior;

an electrically operated valve controlling the flow of the inert gas to the housing interior; and a circuit conductor for using the generated signal to open the inert gas control valve to increase gas pressure in the motor housing to seal the housing against the fluid leakage.

2. A pump as in claim 1 further including an orifice coupling the interior of the sealed motor housing to the fluid confinement chamber to enable gas pressure in the motor housing to force fluid from the confinement chamber to the fluid collector and to provide a back pressure on the fluid seal between the motor shaft and the pump housing.

3. A pump as in claim 2 wherein the fluid confinement chamber is a cavity integrally formed in the pump housing that creates an enclosed chamber by sealably attaching the pump housing to the motor housing.

4. A pump as in claim 3 wherein the orifice coupling the interior of the motor housing to the fluid confinement chamber is in an upper portion of the sealed motor housing.

5. A motor driven pump comprising:

a sealable chamber;

a motor mounted in the sealable chamber for rotating a shaft;

a pump cover having an inlet and an outlet;

a pump impeller in the pump cover being driven by the motor shaft;

a fluid seal between the motor shaft and the pump cover;

a fluid confinement chamber interposed between the sealable chamber and the pump cover such that any fluid leaking past the pump cover seal is collected in the confinement chamber;

a wall of the pump cover serving as a common wall with and sealing the sealable chamber, the motor shaft passing through the common wall to the pump impeller;

a gas seal between the motor shaft and the common wall;

a fluid collector coupled to the confinement chamber for receiving fluid therein by gravity flow;

a fluid level sensor means in the fluid collector for detecting a predetermined fluid level therein and generating an electrical signal at the predetermined level;

a source of pressurized inert gas coupled to the interior of the sealed chamber;

an electrically operated valve controlling the flow of the inert gas to the sealed chamber interior; and a circuit conductor for using the generated signal to open the inert gas valve to increase gas pressure in the sealed chamber to seal the chamber against fluid leakage.

6. A pump as in claim 5 further comprising an orifice in the common wall between the sealable chamber and the fluid confinement chamber to enable gas pressure in the sealable chamber to force fluid from the confinement chamber and to provide a back pressure on the fluid seal between the motor shaft and the pump housing to prevent leakage.

7. A pump as in claim 6 wherein the confinement chamber is a cavity integrally formed with and a part of the pump housing.

8. A pump as in claim 7 wherein the orifice in the common wall is in the upper portion of the common wall.

9. A pump as in claim 1 or claim 5 wherein the motor is an electrical motor.

10. A pump as in claim 1 or claim 5 wherein the inert gas is nitrogen.

11. A motor driven pump comprising:

a motor in a sealed housing for rotating a shaft projecting therefrom;

a pump housing containing a pump rotated by the motor shaft;

a fluid confinement chamber interposed between and sealably coupled to both the motor housing and the pump housing for receiving and draining any leakage fluid from the pump;

a fluid collector coupled to the fluid confinement chamber for receiving the leakage fluid;

an inert gas pressurizing the sealed motor housing to prevent leakage fluid from entering therein; and an orifice coupling the interior of the motor sealed housing to the confinement chamber for forcing leakage fluid from the confinement chamber to the fluid collector.

* * * * *

UNITED STATES PATENT AND TRADEMARK OFFICE

CERTIFICATE OF CORRECTION

PATENT NO. : 5,263,825

DATED : Nov. 23, 1993

INVENTOR(S) : John H. Doolin

It is certified that error appears in the above—identified patent and that said Letters Patent is hereby corrected as shown below:

In claim 1, column 6, line 22, after "the motor", insert --having a--

In claim 1, column 6, line 30, delete "-"

Signed and Sealed this

Twenty-sixth Day of July, 1994

Bruce Lehman

*Attest:*

BRUCE LEHMAN

*Attesting Officer*

*Commissioner of Patents and Trademarks*